US007679482B2

(12) United States Patent
Yamada et al.

(10) Patent No.: US 7,679,482 B2
(45) Date of Patent: Mar. 16, 2010

(54) INDUCTOR

(75) Inventors: Seiichi Yamada, Sendai (JP); Okikuni Takahata, Sendai (JP); Hiroyuki Kamata, Sendai (JP); Fumishirou Tsuda, Sendai (JP); Masahiro Kondo, Sendai (JP)

(73) Assignee: NEC Tokin Corporation, Tokyo (JP)

( * ) Notice: Subject to any disclaimer, the term of this patent is extended or adjusted under 35 U.S.C. 154(b) by 0 days.

(21) Appl. No.: 12/133,614

(22) Filed: Jun. 5, 2008

(65) Prior Publication Data

US 2008/0303624 A1 Dec. 11, 2008

(30) Foreign Application Priority Data

Jun. 8, 2007 (JP) ..... 2007-153030
Apr. 24, 2008 (JP) ..... 2008-114382

(51) Int. Cl.

| | |
|---|---|
| ***H01F 21/06*** | (2006.01) |
| ***H01F 17/06*** | (2006.01) |
| ***H01F 27/28*** | (2006.01) |
| ***H01F 27/29*** | (2006.01) |
| ***H01F 27/02*** | (2006.01) |
| ***H01F 27/24*** | (2006.01) |
| ***H01F 17/04*** | (2006.01) |

(52) U.S. Cl. ..... 336/212; 336/131; 336/178; 336/186; 336/192; 336/83; 336/216; 336/221

(58) Field of Classification Search ..... None
See application file for complete search history.

(56) References Cited

U.S. PATENT DOCUMENTS

| | | | | |
|---|---|---|---|---|
| 3,522,569 | A * | 8/1970 | Oechsle | 336/165 |
| 4,885,445 | A * | 12/1989 | Taniguchi | 219/760 |
| 5,313,176 | A | 5/1994 | Upadhyay | |
| 6,356,179 | B1 * | 3/2002 | Yamada | 336/175 |
| 6,359,541 | B1 * | 3/2002 | Watanabe | 335/301 |
| 6,362,986 | B1 | 3/2002 | Schultz et al. | |
| 6,967,553 | B2 * | 11/2005 | Jitaru | 336/178 |
| 7,023,313 | B2 * | 4/2006 | Sutardja | 336/178 |
| 7,064,643 | B2 | 6/2006 | Matsutani et al. | |
| 7,280,025 | B2 * | 10/2007 | Sano | 336/200 |

(Continued)

FOREIGN PATENT DOCUMENTS

JP 62-87459 A 4/1987

(Continued)

OTHER PUBLICATIONS

P. Wong et al; Performance Improvements of Interleaving VRM's with Coupling Inductors; IEEE Transactions on Power Electronics, vol. 16, No. 4, Jul. 2001.

(Continued)

*Primary Examiner*—Anh T Mai
*Assistant Examiner*—Mangtin Lian
(74) *Attorney, Agent, or Firm*—Frishauf, Holtz, Goodman & Chick, P.C.

(57) ABSTRACT

An inductor includes a first magnetic substance core which has a middle leg, a first outer leg, a second outer leg, and a body portion interconnecting the middle leg, the first outer leg and the second outer leg, and a second magnetic substance core which is arranged to be opposed to the first magnetic substance core. A first conductor is arranged in a first space which is formed by the middle leg, the first outer leg, part of the body portion, and the second magnetic substance core. A second conductor is arranged in a second space which is formed by the middle leg, the second outer leg, part of the body portion, and the second magnetic substance core. The middle leg is formed with a region which is lower in height than the first outer leg, in the same direction as the longitudinal direction of the first outer leg.

23 Claims, 10 Drawing Sheets

U.S. PATENT DOCUMENTS

| | | | | |
|---|---|---|---|---|
| 7,352,269 | B2 * | 4/2008 | Li et al. | 336/170 |
| 7,401,398 | B2 | 7/2008 | Matsutani et al. | |
| 2005/0012582 | A1 | 1/2005 | Sutardja | |
| 2006/0158299 | A1 * | 7/2006 | Sutardja | 336/174 |
| 2007/0252669 | A1 * | 11/2007 | Hansen et al. | 336/212 |

FOREIGN PATENT DOCUMENTS

| | | | |
|---|---|---|---|
| JP | 7-504556 | T | 5/1995 |
| JP | 7-240319 | A | 9/1995 |
| JP | 11-195536 | A | 7/1999 |
| JP | 2000-68129 | A | 3/2000 |
| JP | 2000-306751 | A | 11/2000 |
| JP | 2001-257124 | A | 9/2001 |
| JP | 2002-57039 | A | 2/2002 |
| JP | 2005-64319 | A | 3/2005 |
| JP | 2007-184509 | A | 7/2007 |
| WO | WO 2004/019352 | A1 | 3/2004 |

OTHER PUBLICATIONS

Japanese Office Action dated Jul. 8, 2009 (4 pages), and partial English translation thereof (2 pages), issued in counterpart Japanese Application Serial No. 2008-114382.

* cited by examiner

INDUCTOR

This application is based upon and claims the benefit of priority from Japanese patent application No. 2007-153030, filed on Jun. 8, 2007, and Japanese patent application No. 2008-114382, filed on Apr. 24, 2008, the disclosures of which are incorporated herein in their entirety by reference.

TECHNICAL FIELD

The present invention relates to an inductor, and more particularly to an inductor which is well suited for use in a power source that is configured on the board of an electronic device such as DC-DC converter.

BACKGROUND ART

A DC-DC converter configured using a plurality of coil components can feed as large a current as 20 A or 30 A, in spite of a small size. Therefore, it has come to be arranged on a board as the power source of a CPU.

In recent years, an LSI or the like has lowered a drive voltage for the purpose of power consumption reduction. With the lowering of the drive voltage, a required current has come to reach several tens of ampere, and a voltage drop in a section from the output terminal of the DC-DC converter to the power source terminal of the CPU or the LSI has become problematic. In order to solve the problem, the DC-DC converter has come to be located as near to the CPU or the LSI as possible. As a result, components of small size and low height have been required of the constituents of the DC-DC converter.

On the other hand, the DC-DC converter which is configured on the board has necessitated a current quantity which cannot be supplied by one FET and one choke coil, with the increase of an output current. A multiphase scheme has been adopted for solving this problem.

By way of example, in the multiphase scheme employing 2-phase converters and having an output of 30 A, the two DC-DC converters are built such that each of these converters is configured of an FET and a choke coil which have an output capacity of 15 A in terms of an effective value, and that one smoothing capacitor is shared. On/off timings in the respective FETs are shifted a half cycle in order to prevent the on/off timings from coinciding, thereby to generate DC voltages—currents by the single capacitor.

A problem in the multiphase scheme is that the number of components such as the FETs and the choke coils is doubled. Each of the components becomes smaller because a current capacity is halved. However, a substantial mounting area increases more due to the increase of the number of components. This has resulted in the problem that such DC-DC converters are not appropriate as ones on the board that originally require miniaturization.

A DC-DC converter using a coupling inductor, in a new circuit scheme proposed in order to solve this problem, is disclosed in IEEE TRANSACTION ON POWER ELECTRONICS, VOL. 16, NO. 4, JULY 2001, "Performance Improvements of Interleaving VRMs with Coupling Inductor." With the inductor disclosed here, two inductors are configured by one EI-type core, and the magnitude of an inductance is adjusted by providing a gap. The desired operation of the DC-DC converter employing the inductor has been confirmed. However, the inductor used here has had the problem that, on account of a structure in which windings are wound round outer legs, the windings protrude outside the core, so the geometries of the inductor become large. Besides, the structure in which the windings are wound round the outer legs has the problem that a limitation is imposed on decreasing the DC resistance value of the winding. The structure of this type in which the windings are wound round is also disclosed in Japanese Unexamined Patent Application Publications (JP-A) Nos. H7-240319 and H11-195536.

SUMMARY OF THE INVENTION

The present invention solves the above problems, and provides an inductor of small size and low height so as to suit to the miniaturization of a DC-DC converter.

According to the invention, there is provided an inductor including a first magnetic substance core having which has a middle leg, a first outer leg, a second outer leg, and a body portion interconnecting the middle leg, the first outer leg and the second outer leg; a second magnetic substance core which is arranged to be opposed to the first magnetic substance core; a first conductor which is arranged in a first space that is formed by the middle leg, the first outer leg, part of the body portion and the second magnetic substance core; and a second conductor which is arranged in a second space that is formed by the middle leg, the second outer leg, part of the body portion and the second magnetic substance core; wherein the middle leg is formed with a region which is lower in height than the first outer leg, in the same direction as a longitudinal direction of the first outer leg.

Preferably, that region of the middle leg which is lower in height than the first outer leg has a coupling coefficient set so as to be less than 0.9, the coupling coefficient indicating a degree of electromagnetic coupling that is determined by a self-inductance of the first conductor, a self-inductance of the second conductor and a mutual inductance between the first and second conductors.

When the coupling coefficient becomes larger than the specified value, a leakage inductance lowers, and a DC-DC converter using a coupling inductor enlarges in a ripple current and lowers in power source efficiency.

The first conductor and second conductor are preferred to be rectilinearly arranged along the first space and the second space, respectively.

The first magnetic substance core and the second magnetic substance core are butted through a gap material.

The gap material may be made of a nonmagnetic substance.

The region of the middle leg which is lower in height than the first outer leg is formed so as to couple the first space and the second space.

The region of the middle leg which is lower in height than the first outer leg may be formed at a position at which the middle leg is divided into a plurality of regions.

The region of the middle leg which is lower in height than the first outer leg may be formed to have a uniform height in the same direction over the whole middle leg.

The self-inductances of said first conductor and said second conductor and the mutual inductances between said first and second conductors are adjusted by, at least, a size of that region of the middle leg which is lower in height than the first outer leg.

Preferably, insulating members are disposed at lead-out ports for the first conductor and the second conductor, and the first and second conductors taken out from the lead-out ports are led out to lower surfaces of the insulating members along the insulating members, thereby to form surface mounting terminals at the lower surfaces of the insulating members.

The insulating members each may include conductor passing holes through which the first conductor and second conductor are allowed to pass.

Each of said first conductor and said second conductor respectively arranged in the first space and the second space may be covered with an insulating material.

Preferably, each of the first and second magnetic substance cores is formed of a ferrite material.

Each of the first and second magnetic substance cores preferably has a saturation flux density of at least 550 mT. This corresponds to a saturation flux density which can be presently realized with a ferrite material Each of the first and second magnetic substance cores may be formed of a magnetic substance core into which metal powder is molded.

The conductors and the magnetic substance cores may well be unitarily molded by arranging the powder around the conductors and then press-molding them.

At least one of the first magnetic substance core and the second magnetic substance core may be formed of at least two different magnetic substances.

The first magnetic substance core and the second magnetic substance core may be formed of magnetic substances different from each other.

According to one aspect, a shape of the second magnetic substance core is the same as that of the first magnetic substance core, and the first outer leg, the middle leg and the second outer leg of the first magnetic substance core are respectively arranged in opposition to the corresponding outer legs and the middle leg of the second core.

One of the first and second magnetic substance cores may include an I-type core.

According to the invention, a magnetic circuit length which determines the self-inductance of each conductor and the mutual inductance between conductors is changed, not only by the distance between the conductors that is determined by the interval between a first space and a second space, but also by forming a region which is lower in height than the first outer leg of a magnetic substance core, in the middle leg thereof. Accordingly, the self-inductance of each conductor and the mutual inductance between the conductors can be adjusted without changing the geometries of an inductor. Besides, even when the conductors are rectilinearly arranged in the first space and the second space, respectively, desired inductances can be realized. Therefore, any winding need not be wound round the core, so that the core assembly can be made small in size, and a manufacturing process is simplified. Further, the damage of the core assembly attributed to the winding operation is not apprehended, so that a yield can be enhanced.

According to another aspect of the invention, the thickness of the gap between a first magnetic substance core and a second magnetic substance core is changed, so that the distances between the first and second magnetic substance cores are respectively adjusted at the middle leg and at the outer legs, whereby the self-inductance of each conductor and the mutual inductance between the conductors can desirably be realized. Accordingly, the inductances can be adjusted without changing the geometries of the inductor, and the miniaturization of the inductor can be realized. A nonmagnetic substance, or a material which is lower in permeability than the first magnetic substance core and the second magnetic substance core is employed as the material of the gap, whereby the gap which is stable in the configuration or a product and in electric characteristics can be obtained.

According to still another aspect of the invention, that region of the middle leg which is lower in height than the first outer leg is formed so as to couple the first space and the second space, and this region is formed at a position at which the middle leg is divided into a plurality of regions. Therefore, a configuration in which the self-inductance of each conductor and the mutual inductance between the conductors are successively changed along the current path direction of the conductors can be realized without changing the geometries of the inductor.

Further, even when that region of the middle leg which is lower in height than the first outer leg is formed at a uniform height in the same direction over the whole middle leg, the self-inductance of each conductor and the mutual inductance between the conductors can be adjusted without changing the geometries of the inductor, and the miniaturization of the inductor can be realized.

With a configuration in which a magnetic gap is provided at part of a magnetic circuit if needed, the magnetic substance core assembly is formed using a ferrite material as a core material, whereby the magnetic circuit can be prevented from being magnetically saturated even when a predetermined current is conducted. Further, a material whose saturation flux density is 550 mT or above is employed as the ferrite material, whereby a DC superposition characteristic is enhanced, and the miniaturization of the coil becomes possible.

According to yet another aspect of the invention, the magnetic circuit which is partly formed with the magnetic gap is formed of a magnetic substance core assembly into which metal powder is molded, whereby a current which can be conducted without incurring magnetic saturation can be further heightened.

According to a further aspect of the invention, an inductor is formed by unitarily molding conductors and magnetic powder, whereby the inductor can be refrained from magnetic saturation even when a predetermined current is conducted and a configuration of lower height can be realized without changing the geometries of the inductor.

According to another aspect of the invention, a unitary inductor is formed by combining magnetic substance cores made of magnetic substances which exhibit different magnetic characteristics at parts of different magnetic circuit lengths, whereby one small-sized inductor having necessary characteristics can be realized.

According to other aspect of the invention, conductor take-out parts for taking out conductors are further included, an insulator is disposed on the conductor take-out parts, and the conductors are fixed on the insulator, whereby a small-sized inductor which is excellent in surface mounting can be realized.

DESCRIPTION OF THE EXEMPLARY EMBODIMENTS

Figure 1A:
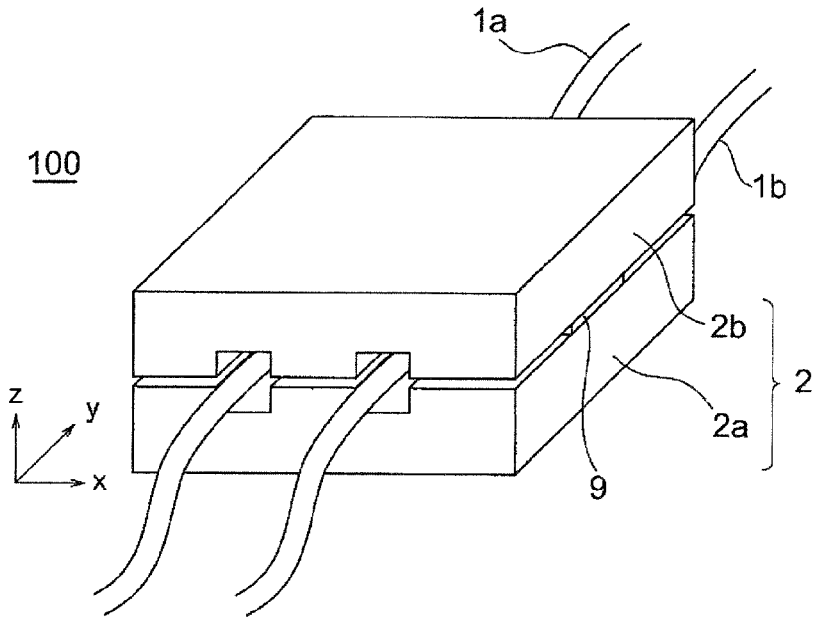
FIG. 1A is a perspective view of an inductor in the first embodiment of the present invention.

Inductors according to embodiments of the present invention will now be described in detail with reference to the drawing.

FIG. 1A is a perspective view showing the external appearance of the inductor illustrative of the first embodiment in the invention. The inductor 100 includes a magnetic substance core assembly 2 which is formed by opposing a second magnetic substance core 2*a* and a first magnetic substance core 2*b* to each other, and two conductors 1*a* and 1*b* which stretch inside and outside the magnetic substance core assembly 2. A gap 9*a* (refer to FIG. 1B) is held by gap materials 9 made of tapes of polyimide, or the likes, between the magnetic substance cores 2*a* and 2*b*. Besides, rectangular copper wires or the likes are appropriately employed as the conductors 1*a* and 1*b* so that conductor parts outside the cores can be used also as mounting terminals. However, it is also allowed to employ round wires.

Figure 1B:
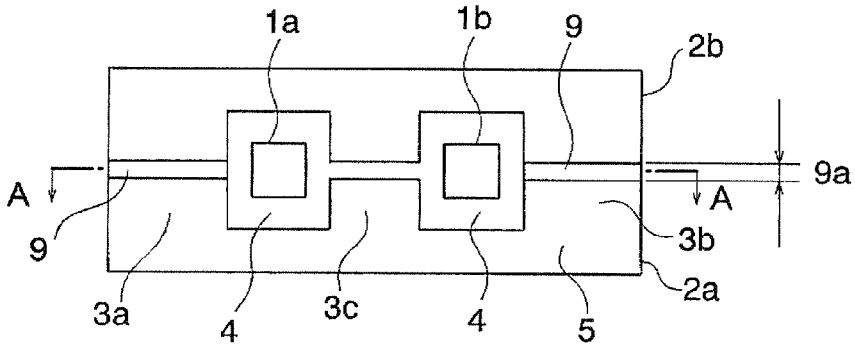
FIG. 1B is a front view with the inductor in FIG. 1A seen from a plane from which conductors are taken out.
Figure 1C:
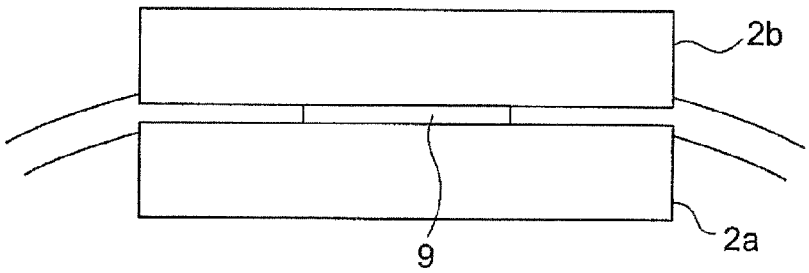
FIG. 1C is a side view with the inductor in FIG. 1A seen from the right side.

FIG. 1B is a front view with the inductor in FIG. 1A seen from a plane from which the conductors are taken out. The second magnetic substance core 2*a* is an E-type core which includes a body portion 5, first and second outer legs 3*a* and 3*b* vertically protruding from both the end sides of the body portion 5, respectively, and a middle leg 3*c* protruding from the middle part of the body portion 5. Accordingly, a first slit is formed by the outer leg 3*a*, the middle leg and the body portion, while a second slit is formed by the outer leg 3*b*, the middle leg 3*c* and part of the body portion. The first magnetic substance core 2*b* has the same structure. The first and second magnetic substance cores 2*b* and 2*a* are arranged while confronting each other through the gap materials 9 in such a manner that their outer legs and their middle legs oppose to each other. The first conductor 1*a* and the second conductor 1*b* are arranged in voids 4 which are formed between the respective magnetic substance cores. The magnetic substance cores 2*b* and 2*a* may be joined by the gap materials 9 in the shape of adhesive tapes. Alternatively, they may well be joined in such a way that the gap materials 9 are arranged at parts of the first outer legs 3*a* and the second outer legs 3*b*, and that parts to which the gap materials 9 are not applied is coated with an adhesive (not shown). Further, these joining methods may well be combined. FIG. 1C is a side view with the inductor 100 seen from a plane from which the conductors 1*a* and 1*b* are not taken out, that is, a right side in FIG. 1A.

Figure 2:
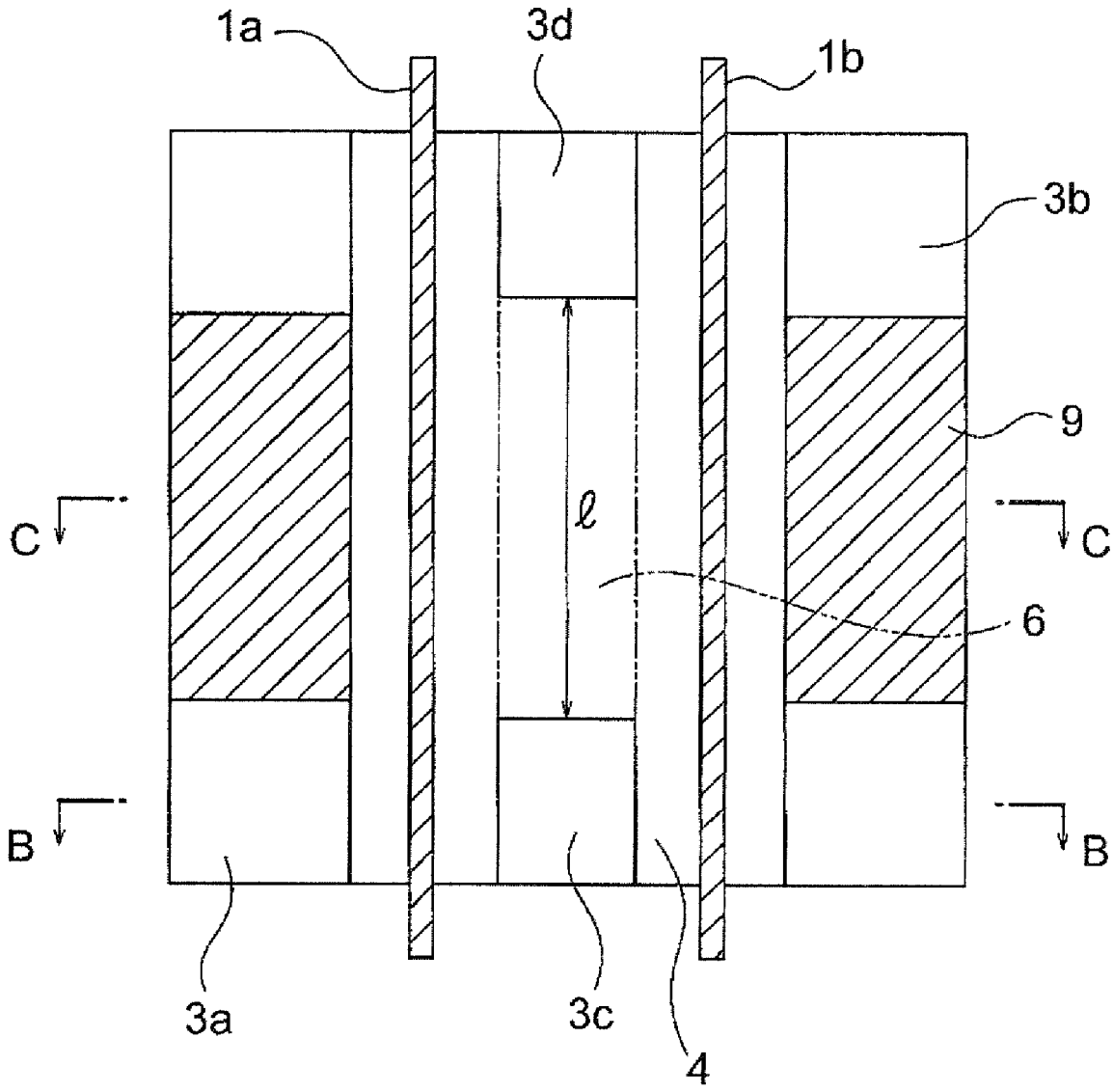
FIG. 2 is a sectional view taken along line A-A in FIG. 1B.

FIG. 2 is a sectional view taken along line A-A in FIG. 1B. The second magnetic substance core 2*a* includes the outer legs 3*a* and 3*b*, the middle legs 3*c* and 3*d*, the body portion, and the first and second slits formed by these constituents. The slits of the second magnetic substance core 2*a* form the voids 4 together with the first magnetic substance core 2*b*. The first conductor 1*a* and the second conductor 1*b* are arranged in the voids 4. A middle-leg non-formation part 6 continuous to the voids 4 is provided between the middle legs 3*c* and 3*d*. The middle-leg non-formation part 6 is a region which is lower in height than the outer leg parts in the middle legs. Besides, the gap materials 9 are applied to parts of the surfaces of the outer legs 3*a* and 3*b*. The first magnetic substance core 2*b* has the same configuration as that of the second magnetic substance core 2*a*.

Figure 3A:
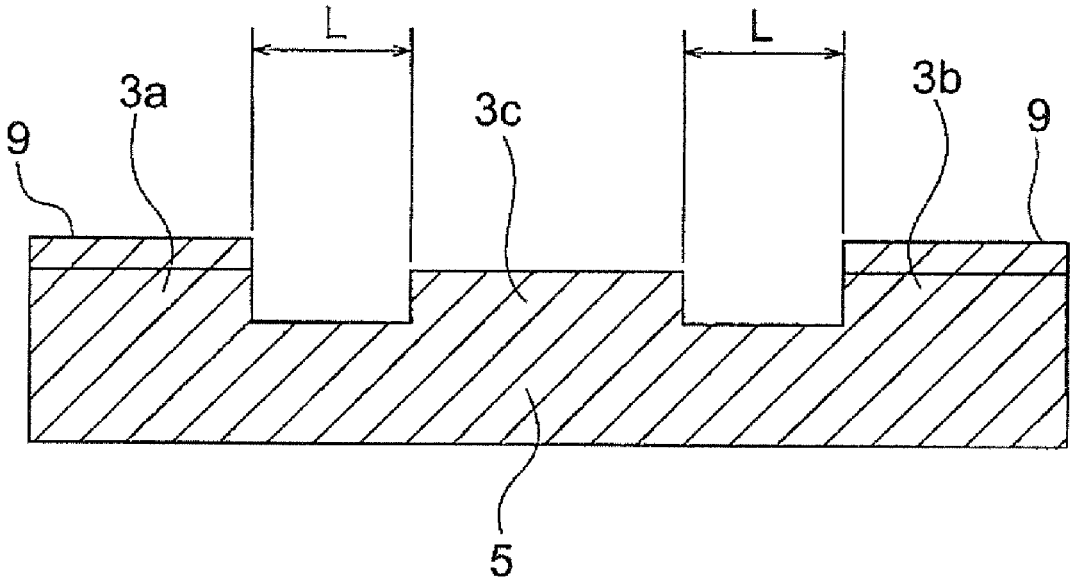
FIG. 3A is a sectional view taken along line B-B in FIG. 2.
Figure 3B:
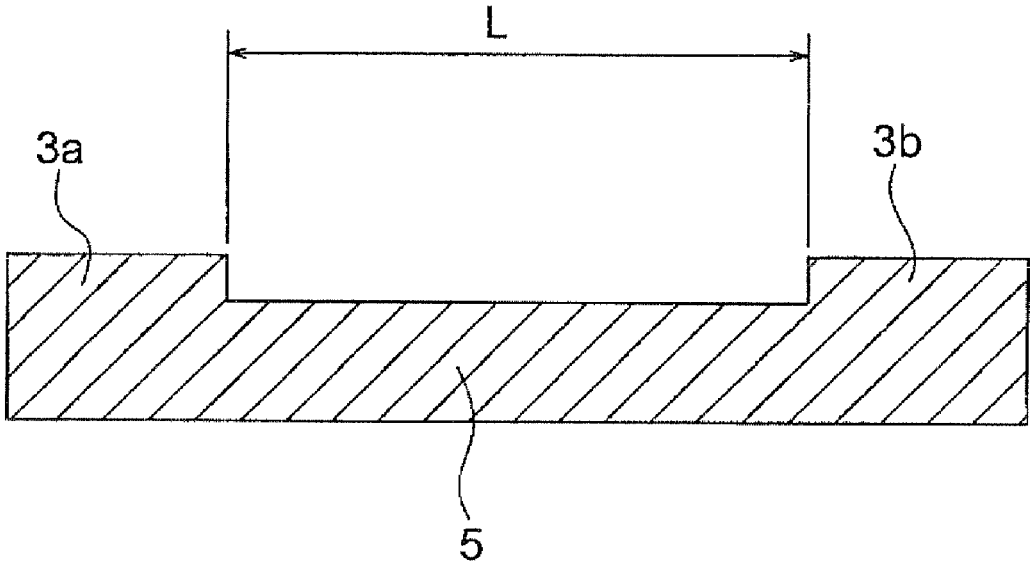
FIG. 3B is a sectional view taken along line C-C in FIG. 2.

FIG. 3A shows a sectional view taken along line B-B in FIG. 2, while FIG. 3B shows a sectional view taken along line C-C in FIG. 2. As shown in FIG. 3A, the middle leg 3*c* is arranged between the two conductors at that part of the magnetic substance core which corresponds to the line B-B in FIG. 2. Therefore, the magnetic coupling between the conductors is weakened, and the conductors at a position corresponding to the line B-B become a portion which operates substantially as a normal choke coil. Besides, the voids 4 (refer to FIG. 2) in which the conductors are arranged are filled up with a paste containing magnetic substance powder, so as to cover the respective conductors with a magnetic substance, whereby the normal choke coil may well be operated by further decreasing the magnetic coupling between the conductors.

On the other hand, as shown in FIG. 3B, at the part of the magnetic substance core corresponding to the line C-C in FIG. 2, the middle-leg non-formation part 6 is arranged between the two conductors, and the middle legs made of the magnetic substance are not existent. Therefore, most magnetic fluxes round through the first and second conductors, the magnetic coupling between these conductors is intensified, and the conductors at a position corresponding to the line C-C become a portion which operates substantially as a common choke coil. Further, a magnetic substance (not shown) which is lower in permeability than the magnetic substance core is arranged at the middle-leg non-formation part so as to intensify the magnetic coupling between the conductors, whereby the conductors may well be operated as the common-mode choke coil.

In this manner, the magnetic substance core in the inductor of the first embodiment is so configured that magnetic circuit lengths rounding through the conductors along these conductors are different. The inductance components of the inductor having the configuration of the different magnetic path lengths consist of the part of the normal choke whose coupling coefficient is substantially zero, and the part of the common choke coil whose coupling coefficient is substantially one. Besides, the whole inductor becomes equivalent to a structure in which the coupling coefficient of the part of the normal choke coil and that of the part of the common choke coil are connected in series, so that the coupling coefficient of the inductor can be adjusted to any desired value between zero and one. Incidentally, the coupling coefficient of the inductor is determined by a line length corresponding to the part of the normal choke coil, and the line length of the part corresponding to the common-mode choke coil. Therefore, a sequence in which the coupling coefficients are connected in series can be determined at will in accordance with the facilities of manufacture and assemblage.

Figure 4A:
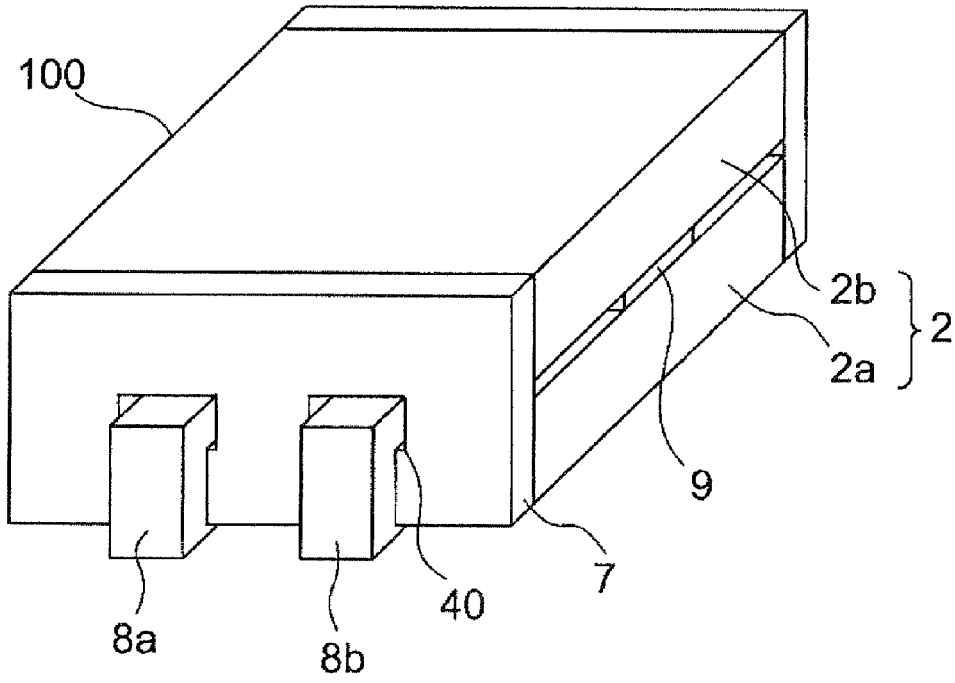
FIG. 4A is a perspective view showing a structure mountable on a board, as to the inductor of the first embodiment of the invention.
Figure 4B:
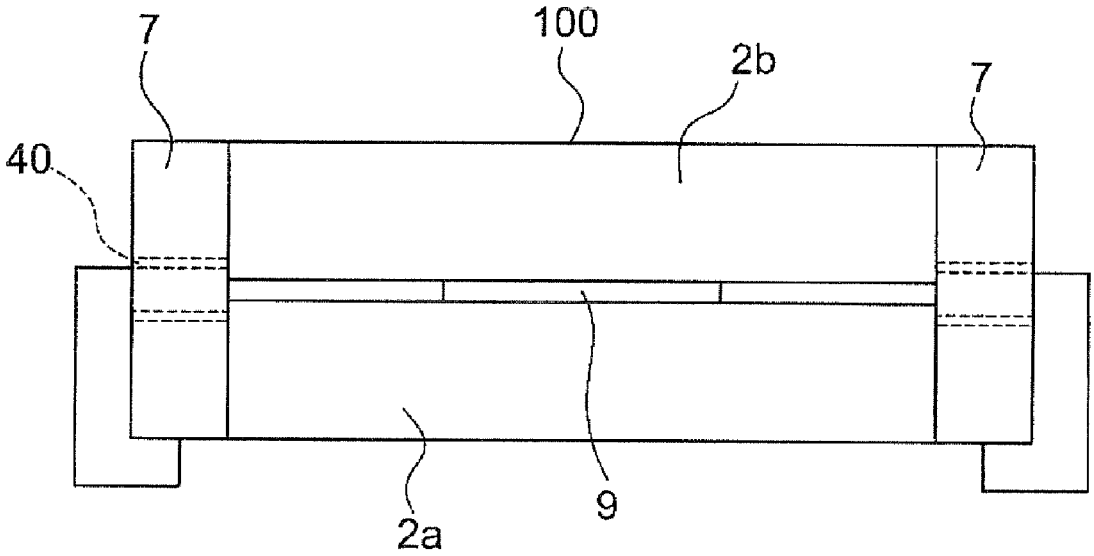
FIG. 4B is a side view with the inductor in FIG. 4A seen from the right side.
Figure 5A:
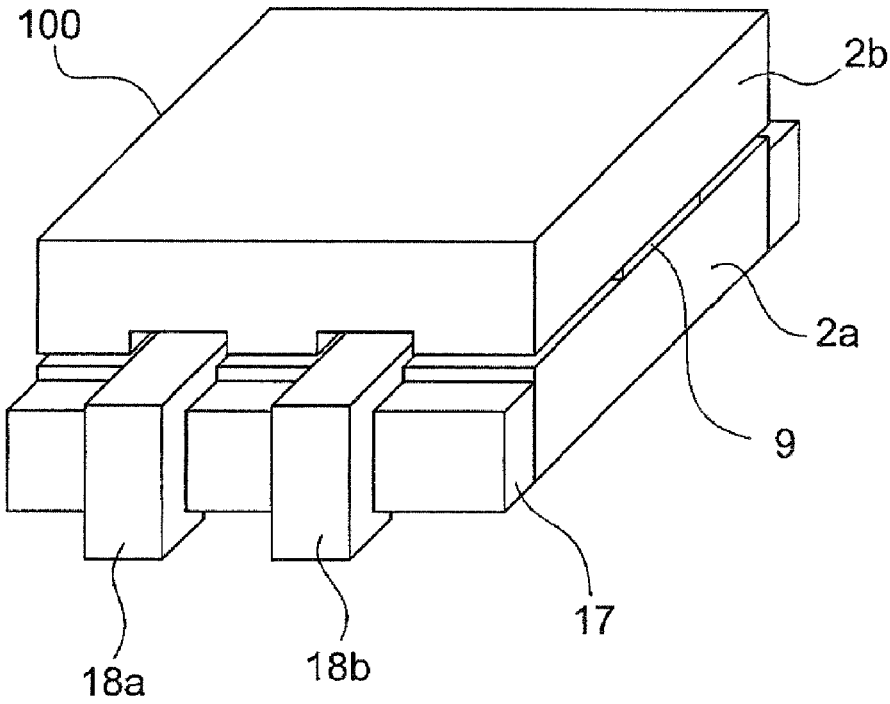
FIG. 5A is a perspective view showing a structure mountable on a board, as to the inductor of the first embodiment of the invention.
Figure 5B:
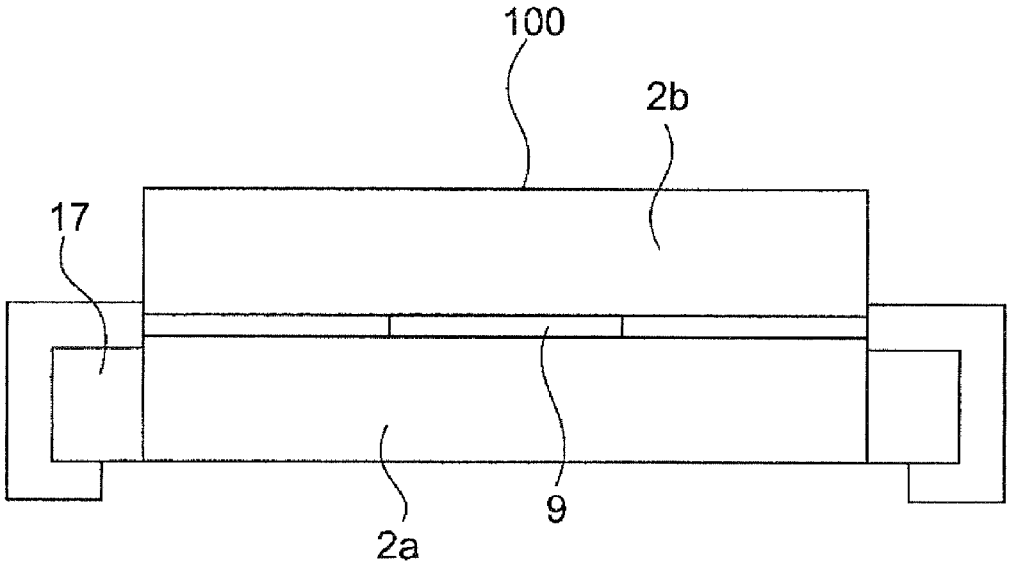
FIG. 5B is a side view with the inductor in FIG. 5A seen from the right side.

FIG. 4A and FIG. 4B are an external-appearance perspective view and a side view showing a structure in the case where the inductor shown in FIGS. 1A and 1C is mounted on a board, respectively. Here, flat insulating members 7 are disposed on those sides of the inductor 100 from which conductors are taken out, and the insulating members 7 are formed with penetrating holes 40 at positions corresponding to the voids 4 shown in FIG. 1B. The rectangular conductors 8*a* and 8*b* are taken out from the penetrating holes 40, and bent around the flat insulating members to provide mounting terminals at the bottom of the inductor. Incidentally, as shown in FIGS. 5A and 5B, insulating members 17 may well be disposed only on the side of the second magnetic substance core 2*a* so that each of mounting terminals 18*a* and 18*b* clamps the insulating members 17.

Figure 6A:
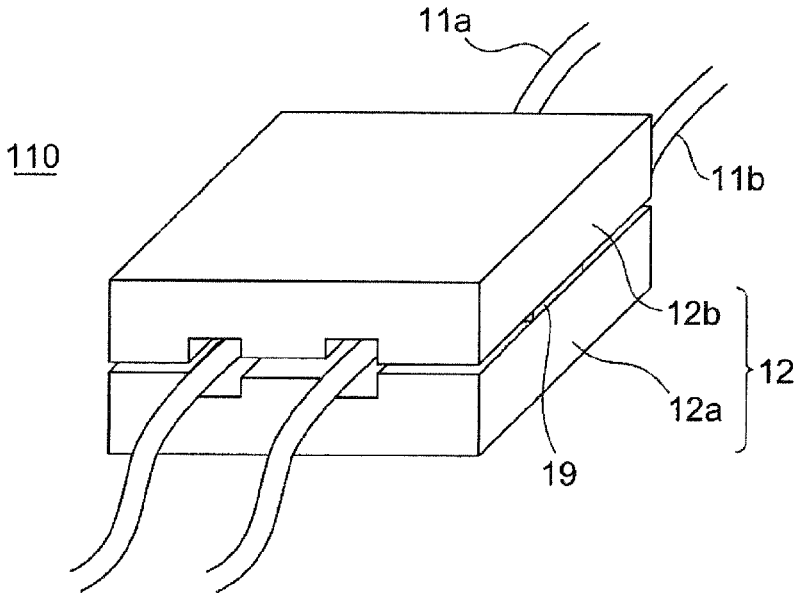
FIG. 6A is a perspective view of an inductor in the second embodiment of the invention.

Next, an inductor illustrative of the second embodiment in the invention will be described in detail. FIG. 6A is a perspective view showing the external appearance of the inductor illustrative of the second embodiment in the invention. The inductor 110 includes a magnetic substance core assembly 12 which is formed by opposing a second magnetic substance core 12*a* and a first magnetic substance core 12*b* to each other, and two conductors 11*a* and 11*b* which are arranged inside and outside the magnetic substance core assembly 12. Here, a gap 19*a* is formed of gap materials 19 made of tapes of polyimide, or the likes, between the magnetic substance cores 12*a* and 12*b*. Besides, rectangular copper wires or the likes are appropriately employed as the conductors 11*a* and 11*b* so that these conductors can be used also as mounting terminals. However, it is also allowed to employ round wires.

Figure 6B:
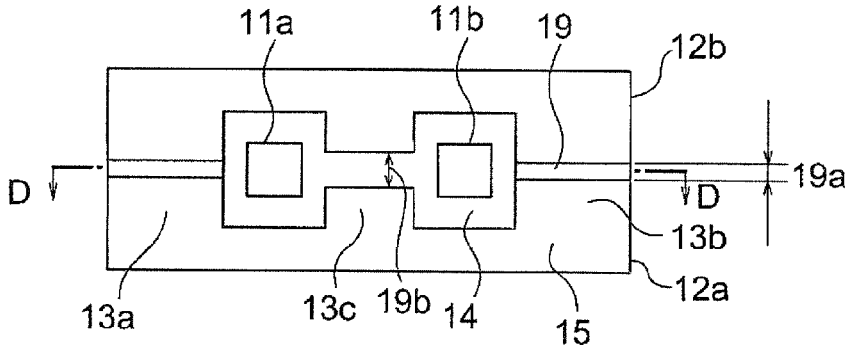
FIG. 6B is a front view with the inductor in FIG. 6A seen from a plane from which conductors are taken out.
Figure 6C:
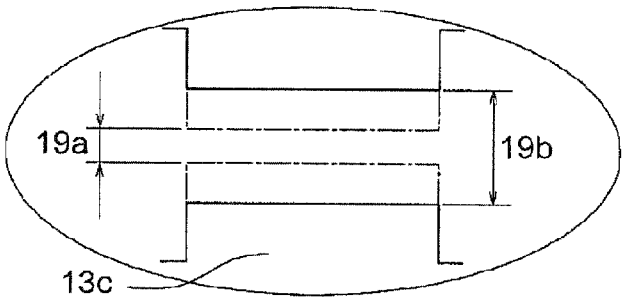
FIG. 6C is an enlarged view illustrating a relationship between a gap formed by opposing middle legs and a gap formed by opposing outer legs.

FIG. 6B is a front view with the inductor in FIG. 6A seen from a plane from which the conductors are taken out. Each of the first and second magnetic substance cores is an E-type core which includes a body portion 15, outer legs 13*a* and 13*b* protruding from both the end sides of the body portion 15, respectively, and a middle leg 13*c* protruding from the middle part of the body portion 15. The first and second magnetic substance cores are arranged through the gap materials 19 while confronting each other in such a manner that their outer legs and their middle legs oppose to each other. The size of a gap 19*b* formed between the middle legs is larger than the size of each gap 19*a* formed by the gap material 19 between the outer legs. FIG. 6C is an enlarged view of the part of the gap 19*b* in FIG. 6B. A middle-leg non-formation part in the second magnetic substance core 12*a* here indicates the space of that part of the middle leg at which the height of the middle leg does not reach the height of each outer leg. The first conductor 11*a* and the second conductor 11*b* are respectively arranged in voids 14 which are formed between the magnetic substance cores. Incidentally, an external-appearance side view with the inductor 110 seen from a plane from which the conductors are not taken out becomes approximately the same as FIG. 1C.

Figure 7:
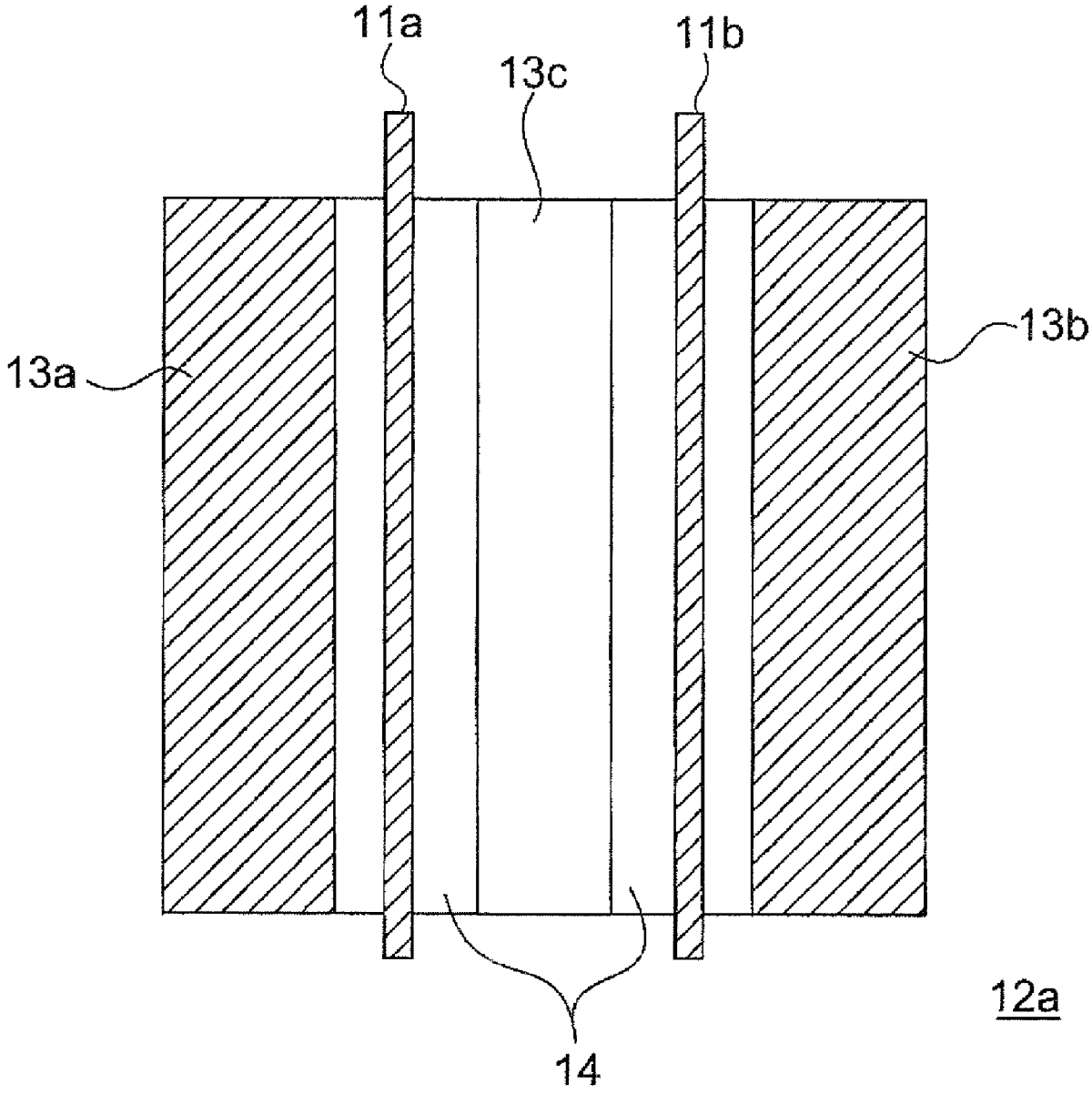
FIG. 7 is a sectional view taken along line D-D in FIG. 6B.

FIG. 7 is a sectional view taken along line D-D in FIG. 6B. The second magnetic substance core 12*a* includes the outer legs 13*a* and 13*b*, the middle leg 13*c*, and two slits. The slits oppose to the slits of the first magnetic substance core 12*b*, respectively, thereby to constitute the voids 14. The first conductor 11*a* and the second conductor 11*b* are respectively arranged in the voids 14. Unlike in the first embodiment, the middle-leg non-formation part is not arranged so as to divide the middle leg, and the middle leg 13*c* is formed so as to be continuous from that one side surface of the magnetic substance core from which the conductors are taken out, to the other side surface opposing thereto. Incidentally, also in this embodiment, the first magnetic substance core 12*b* has the same configuration as that of the second magnetic substance core 12*a*.

As shown in FIGS. 6B and 7, the height of the middle leg 13*c* from the body portion 15 and the height of the first and second outer legs 13*a* and 13*b*, from the body portion 15, are made different from each other. Thus, the magnetic reluctance of a magnetic path which enters the middle leg 13*c* from the outer leg 13*a* through the body portion 15 and which returns to the outer leg 13*a* through the body portion 15, and the magnetic reluctance of a magnetic path which enters the other outer leg 13*b* from the outer leg 13*a* through the body portion 15 and which returns to the outer leg 13*a* through the body portion 15, can be respectively adjusted. The magnetic reluctance of the former magnetic circuit is predominant in the characteristic of a normal-mode choke, while the magnetic reluctance of the latter magnetic circuit is predominant in the characteristic of a common-mode choke. Accordingly, the magnetic coupling between the two conductors can be adjusted by adjusting the magnetic reluctances of the two magnetic circuits in this manner. Concretely, the gap 19*b* between the middle legs of the first and second magnetic substance cores is made larger than the gap 19*a* between the outer legs thereof, whereby the magnetic reluctance of the magnetic circuit rounding through the middle legs becomes larger than the magnetic reluctance of the magnetic circuit rounding through the outer legs, and magnetic fluxes passing through the middle legs become less than magnetic fluxes passing through the outer legs. Consequently, the magnetic coupling between the two conductors approximates to the common mode. To the contrary, when the middle-leg non-formation part is made small to narrow the gap between the middle legs, the magnetic coupling as the normal-mode choke coil enlarges, and the magnetic coupling between the two conductors approximates to zero.

In this manner, also in the second embodiment, the middle-leg non-formation part is formed, and the ratio between the gap 19*b* of the middle legs and the gap 19*a* of the outer legs is adjusted, whereby the coupling coefficient between the conductors can be set between zero and one.

Figure 8A:
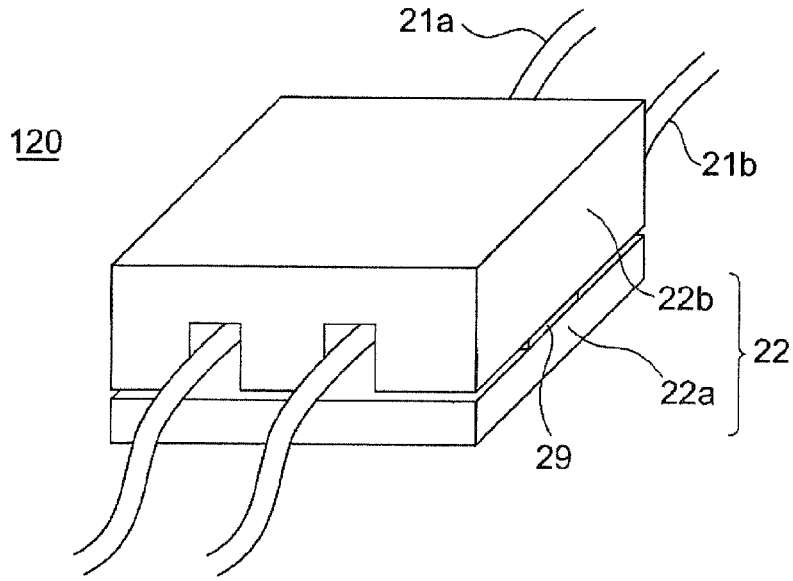
FIG. 8A is a perspective view of an inductor in the third embodiment of the invention.

Next, an inductor illustrative of the third embodiment in the invention will be described in detail. FIG. 8A is a perspective view showing the external appearance of the inductor illustrative of the third embodiment in the invention. The inductor 120 includes a magnetic substance core assembly 22 which is formed by combining a second magnetic substance core 22*a* and a first magnetic substance core 22*b* to each other, and two conductors 21*a* and 21*b* which are stretched from inside the core assembly to outside the core assembly. The conductors are respectively taken out from opposing surfaces in the magnetic substance core assembly 22. Here, a gap 29*a* is formed of a gap material 29 made of a tape of polyimide, or the like, between the magnetic substance cores 22*a* and 22*b*. Besides, rectangular copper wires or the likes are appropriately employed as the conductors 21*a* and 21*b* so that these conductors can be used also as mounting terminals. However, it is also allowed to employ round wires.

Figure 8B:
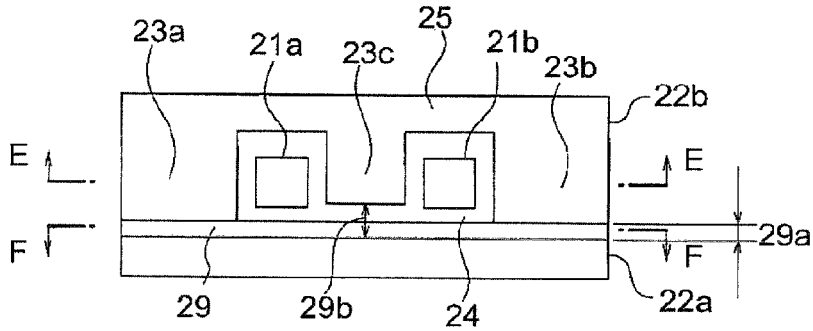
FIG. 8B is a front view with the inductor in FIG. 8A seen from a plane from which conductors are taken out.
Figure 8C:
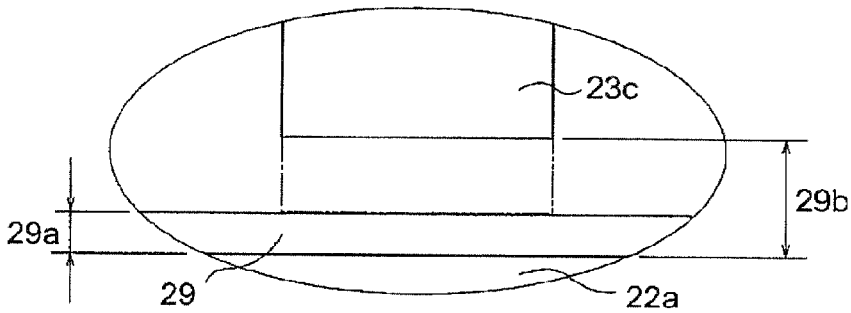
FIG. 8C is a enlarged view showing a relationship between a gap formed by a middle leg and a second magnetic substance core and a gap formed by an outer leg and the second magnetic substance core.

FIG. 8B is a front view with the inductor in FIG. 8A seen from a plane from which the conductors are taken out. The second magnetic substance core 22*a* is an I-type core which is flat. The first magnetic substance core 22*b* is an E-type core which includes a body portion 25, outer legs 23*a* and 23*b* protruding from both the end sides of the body portion 25, respectively, and a middle leg 23*c* protruding from the middle part of the body portion 25. That side of the first magnetic substance core 22*b* on which the outer legs 23*a* and 23*b* and the middle leg 23*c* is combined with the second magnetic substance core 22*a* through the gap material 29, thereby to form the magnetic substance core assembly 22. The size of a gap 29*b* which is formed between the middle leg 23*c* of the first magnetic substance core being the E-type core and the I-type core forming the second magnetic substance core is larger than the size of the gap 29*a* which is formed between each of the outer legs of the first magnetic substance core and the I-type core. In FIG. 8C, this relation is shown in an exaggerated fashion. Besides, the first conductor 21*a* and the second conductor 21*b* are arranged in voids 24 which are formed between the middle leg and outer legs of the E-type magnetic substance core. The height of each outer leg from the body portion in the E-type core is larger than the diameter of each of the first conductor 21*a* and the second conductor 21*b* so that the conductors can be arranged in the voids.

Figure 9A:
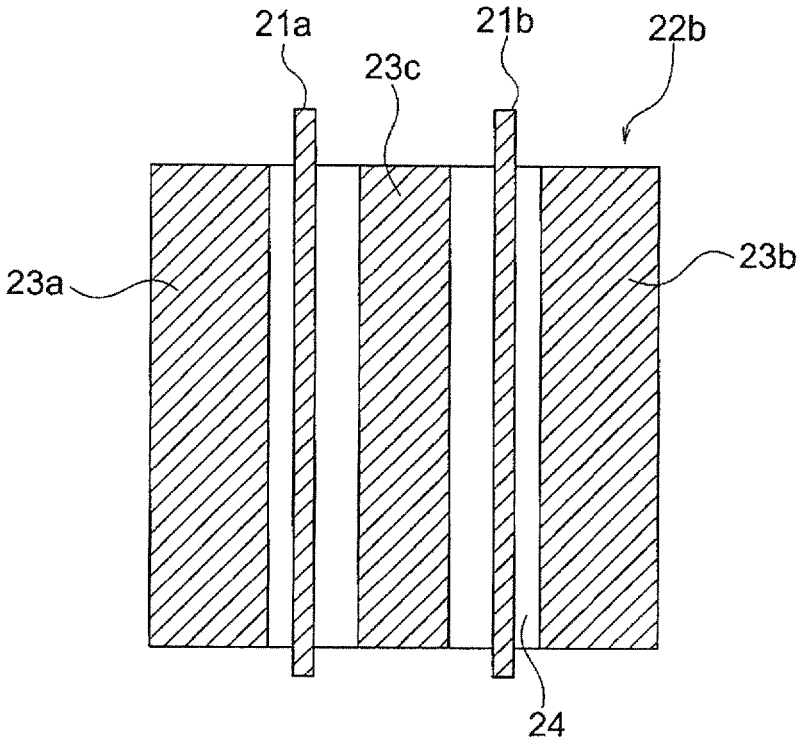
FIG. 9A is a sectional view taken along line E-E in FIG. 8B.
Figure 9B:
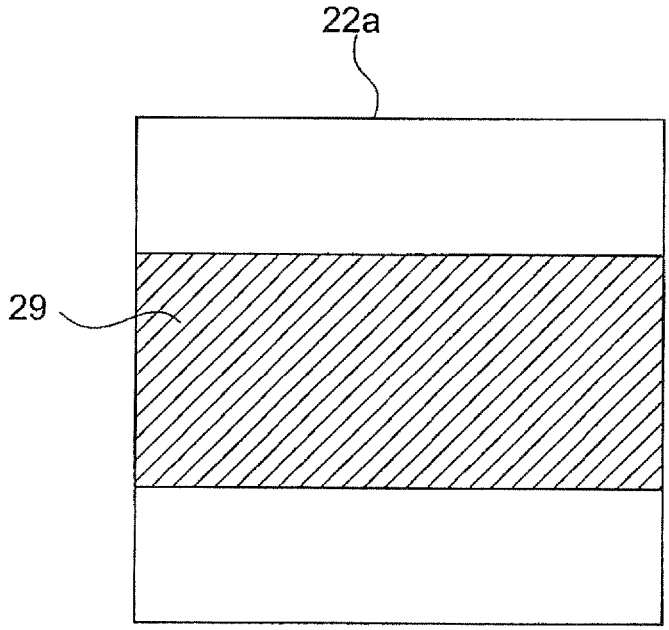
FIG. 9B is a sectional view taken along line F-F in FIG. 8B.

FIG. 9A is a sectional view taken along line E-E in FIG. 8B. The first magnetic substance core 22*b* includes the outer legs 23*a* and 23*b*, the middle leg 23*c*, and the voids 24, and the first conductor 21*a* and second conductor 21*b* are arranged in the voids 24. FIG. 9B is a sectional view taken along line F-F in FIG. 8B. The gap material 29 is arranged extending from near the middle of one side surface of the second magnetic substance core 22*a* being the I-type core, on a side from which the conductors are not taken out, to near the middle of the other side surface.

In this embodiment, a middle-leg non-formation part is formed in the first magnetic substance core being the E-type core, and the middle-leg non-formation part in the first magnetic substance core signifies the space of that part of the middle leg at which the height of the middle leg does not reach the height of the outer legs. As in the second embodiment, the height of the middle leg 23*c* from the body portion 25 is made smaller than the height of the outer legs 23*a* and 23*b* from the body portion 25, and the magnetic reluctance of a magnetic circuit rounding through the middle leg is made larger than that of a magnetic circuit rounding through the outer legs, whereby the degree of the magnetic coupling between the two conductors can be adjusted. The second magnetic substance core is made the I-type, and the height of the outer legs of the first magnetic substance core from the body portion is made larger than the diameter of the conductors, so that the gap material need not be attached in adaptation to the outer legs of the E-type core. Therefore, a manufacturing efficiency can be sharply enhanced. Besides, one of the magnetic substance cores can be made the I-type core being structurally simple, to bring forth the advantage that a manufacturing yield is enhanced.

Figure 10A:
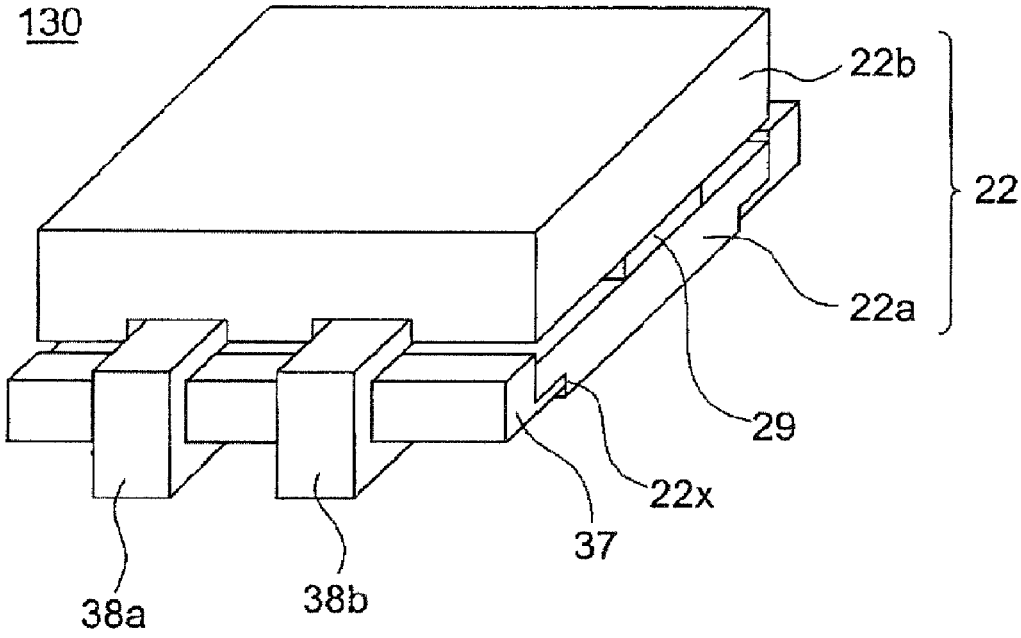
FIG. 10A is a perspective view showing a structure mountable on a board, as to the inductor of the third embodiment of the invention.
Figure 10B:
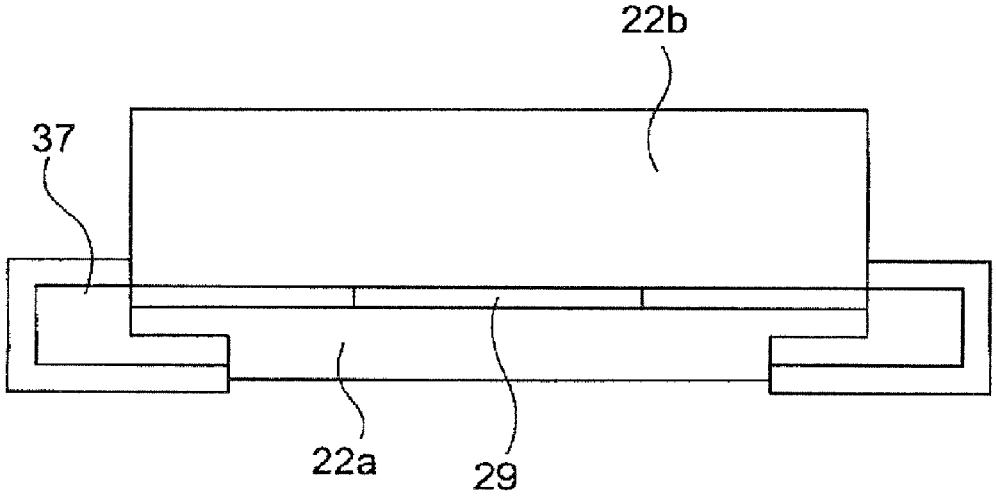
FIG. 10B is a side view with the inductor in FIG. 10A seen from the right side.

FIG. 10A and FIG. 10B are an external-appearance perspective view and a side view showing a structure in the case where the inductor shown in FIGS. 8A and 8C is mounted on a board, respectively. Here, insulating members 37 are disposed on those sides of the inductor 130 from which conductors are taken out, and the rectangular conductors 38*a* and 38*b* are taken out from the magnetic substance cores. Here is adopted a configuration in which mounting terminals bent onto the side of a mounting surface extend just under the second magnetic substance core 22*a*. In order to prevent the magnetic substance of the core 22*a* and the mounting terminals from short-circuiting, each insulating member 37 is disposed, not only on the side surface from which the conductors are taken out, but also on the mounting surface side of the inductor. In this case, cut-away parts 22*x* for accommodating the thinned portions of the insulating members and the terminals should preferably be provided on the mounting surface side of the I-type core. This structure refrains the height of the inductor from being influenced by the thickness of the insulating members. The first and second conductors are respectively bent onto the mounting surface side in a manner to embrace the insulating members 37, and accommodated in the cut-away parts provided on the mounting surface side of the I-type core. In this structure, the parts of the first and second conductors on the mounting surface side serve also as the mounting terminals.

Each of the above embodiments has employed the structure in which the conductors taken out from inside of the inductor are directly employed as the mounting terminals, but mounting terminals may well be disposed separately from the conductors. Besides, in mounting the conductors, the insulating members have been attached, but they can be omitted if the magnetic substance cores are not electrically conductive. Further, the gap material of uniform thickness should preferably be employed, but only an adhesive or the like may well be used as a gap material. A material for forming the magnetic substance cores may be appropriately made of a ferrite material, a molded compact of metal powder, a molded compact in which an electric conductor and magnetic powder are unitarily molded, or the combination of these materials, so as to attain a desired coupling coefficient. Besides, in the first and second embodiments, the first and second magnetic substance cores have had the identical E-type shape, but they may well have different shapes. Further, the magnetic substance cores may well be joined by coating the gap part not provided with the gap material, with the adhesive, or they may well be joined by putting the gap material into the shape of the adhesive tape. The cut-away parts used in the third embodiment are also applicable to the first and second embodiments.

In this manner, in the invention, the middle-leg non-formation part is formed, and the single inductor structurally includes both the portion which operates substantially as the normal choke and the portion which operates substantially as the common choke coil, whereby the inductor of small size and low height can be obtained. Further, when the material of the magnetic substance is appropriately selected, the inductor of low loss can be obtained.

EXAMPLES

The present invention will now be described in detail in conjunction with examples.

Example 1

Using an NiZn ferrite which had a permeability of 600 and a saturation flux density of 450 mT, a second magnetic substance core 2*a* of E-type as shown in FIG. 2 was prepared so as to have a width of 8 mm, a length of 12 mm and a height of 3.6 mm. A first magnetic substance core 2*b* to pair with the second magnetic substance core 2*a* was also prepared in the same shape as that of the second magnetic substance core 2*a*. The outer legs 3*a* and 3*b* and the middle legs 3*c* and 3*d* of these cores 2*a* and 2*b* were butted against each other through gap materials 9, into a magnetic substance core assembly 2, whereby an inductor 100 shown in FIG. 1 was fabricated. Besides, each of the middle legs 3*c* and 3*d* of the magnetic substance cores was configured having a width of 1.0 mm and a length of 1.0 mm. Further, each of the middle-leg non-formation parts of the magnetic substance cores was so configured that its length l was 10 mm, and each of voids 4 serving as the inlets/outlets of conductors was configured so as to become (1.4 mm in width)×(1.4 mm in height). The "height" signifies a dimension in the direction in which the outer leg rises from the body portion of the core, the "length" a dimension in the longitudinal direction of the outer leg (the direction in which the conductor extends within the core), and the "width" a dimension in the direction which is perpendicular to the longitudinal direction of the outer leg. Here, a gap 9*a* was formed in such a way that tapes of polyimide, each of which is 20 μm thick and in each of which one surface is sticky, were pasted on parts of the first outer leg and the second outer leg of one of the magnetic substance cores as the gap materials. Incidentally, the magnetic substance cores were joined by coating parts at which the gap materials were not disposed, with a nonmagnetic adhesive. The conductors of round wires, each having a length of 20 mm and a wire diameter of 1.1 mm, were inserted into the resulting magnetic material core assembly.

As the electric characteristics of the inductor, the self-inductance Ls of each conductor became 0.48 μH, and the coupling coefficient K between the conductors became 0.83. Incidentally, a leakage inductance seen from one conductor as is required for the operation of a DC-DC converter was 0.082 μH.

The leakage inductance is derived from Ls·(1−K) and corresponds to an inductance value in a state in which the two conductors carry the same currents in the opposite directions concurrently. Therefore, it is important to verify the leakage inductance versus an output current (smoothed current) required in the operating state of a power source, and the inductor can be used as a choke coil if the leakage inductance does not lower even in a state where the required current is outputted. Table 1 indicates the list of the electrical performances of the inductor in Example 1.

TABLE 1

| Output Current (A) | Coupling Coefficient K | Self-Inductance Ls (μH) | Leakage Inductance (μH) |
|---|---|---|---|
| 0 | 0.83 | 0.48 | 0.082 |
| 10 | 0.83 | 0.19 | 0.032 |
| 20 | 0.77 | 0.12 | 0.028 |

It is seen from the result of Table 1 that the self-inductance Ls greatly lowers down to ¼ with the increase of the output current, but that the leakage inductance becoming the substantial inductance of the conductor undergoes the lowering of about ⅓. Accordingly, the inductor which can satisfactorily operate the DC-DC converter has been fabricated.

Example 2

In this example, an inductor was fabricated under the same conditions as in Example 1, except that only the length l of the middle-leg non-formation part in Example 1 was altered. Table 2 indicates the list of the electrical performances of the inductor in Example 2.

TABLE 2

| Middle-leg non-formation part (mm) | Coupling Coefficient K | Self-Inductance Ls (μH) | Leakage Inductance (μH) |
|---|---|---|---|
| 0 | 0.55 | 0.64 | 0.29 |
| 2 | 0.60 | 0.63 | 0.25 |
| 4 | 0.65 | 0.61 | 0.22 |
| 8 | 0.76 | 0.57 | 0.14 |
| 12 | 0.92 | 0.52 | 0.04 |

From the result of Table 2, it has been confirmed that the coupling coefficient K and the leakage inductance are respectively adjustable in a range of from 0.55 to 0.92 and in a range of from 0.29 to 0.04 by changing the length of the middle-leg non-formation part.

Example 3

In this example, an inductor was fabricated under the same conditions as in Example 2, except that an MnZn ferrite having a permeability of 2200 and a saturation flux density of 510 mT was employed. Table 3 indicates the list of the electrical performances of the inductor in Example 3.

TABLE 3

| Middle-leg non-formation part (mm) | Coupling Coefficient K | Self-Inductance Ls (μH) | Leakage Inductance (μH) |
|---|---|---|---|
| 0 | 0.56 | 0.87 | 0.39 |
| 2 | 0.61 | 0.80 | 0.35 |
| 4 | 0.66 | 0.83 | 0.29 |
| 8 | 0.78 | 0.78 | 0.10 |
| 12 | 0.94 | 0.71 | 0.05 |

Table 3 indicates the coupling coefficient K and the inductances depending on changes in the length l of the middle-leg non-formation part in the case of employing the MnZn ferrite core assembly. It is seen from the result of Table 3 that the coupling coefficient K exhibits almost the same values as in the case of employing the NiZn ferrite in Table 2, but that the self-inductance Ls has attained larger values in correspondence with the higher permeability of the material. Thus, it has been confirmed that, even in the case of using the material of different permeability characteristics, the inductors of different coupling coefficients K can be fabricated.

Example 4

Using the MnZn ferrite which had a permeability of 2,200 and a saturation flux density of 510 mT, a second magnetic substance core 12*a* shown in FIG. 7 was prepared so as to become 10 mm in width, 14 mm in length and 2.0 mm in height, while a first magnetic substance core 12*b* to pair with the second magnetic substance core 12*a* was prepared in the same shape as that of the second magnetic substance core 12*a*. The outer legs 13*a* and 13*b* and the middle legs 13*c* of the second magnetic substance core 12*a* and the first magnetic substance core 12*b* were respectively butted against each other, thereby to fabricate an inductor 110 shown in FIG. 6A. Besides, the widths of the outer legs 13*a* and 13*b* and middle legs 13*c* were all set at 1.8 mm. Here, the differences between the gaps of the middle legs and the gaps of the outer legs were set at 160 μm in all samples. The gaps 19*a* of the outer legs in each of the samples were formed in such a way that gap materials of polyimide, in each of which one surface was sticky, were pasted on parts of the first outer leg and the second outer leg of one of the magnetic substance cores. The change of the coupling coefficient K between conductors in the inductor was investigated as to cases where the thicknesses of the polyimide tapes were 40 μm, 70 μm and 100 μm. Incidentally, the magnetic substance cores were joined to each other by coating parts not provided with the gap materials, with a nonmagnetic adhesive. Table 4 indicates the obtained relationship between inductance values and the gaps of the outer legs.

TABLE 4

| Gap magnitude of Outer legs (μm) | Coupling Coefficient K | Self-Inductance Ls (μH) | Leakage Inductance (μH) |
|---|---|---|---|
| 40 | 0.50 | 0.48 | 0.24 |
| 70 | 0.34 | 0.32 | 0.21 |
| 100 | 0.23 | 0.25 | 0.20 |

As indicated in Table 4, by changing the magnitude of the gaps 19*a* of the outer legs while keeping constant the differences between the gaps of the middle legs and the gaps of the outer legs, the inductors are provided in which the coupling coefficients K between the conductors range from 0.23 to 0.5 have been fabricated. Thus, it has been confirmed that the inductors of different coupling coefficients K can be fabricated by adjusting the gaps of the outer legs.

Example 5

An inductor which included a second magnetic substance core of I-type, 22*a* and a first magnetic substance core of E-type, 22*b* as shown in FIGS. 8A and 8B, was fabricated using an MnZn ferrite which had a permeability of 2,200 and a saturation flux density of 590 mT. The outer legs 23*a* and 23*b* and middle leg 23*c* of the first magnetic substance core 22*b* were opposed to the second magnetic substance core 22*a*, thereby to fabricate a magnetic substance core assembly 22 through a gap material 29. The geometries of the magnetic substance core assembly were 10 mm in width and 14 mm in length, and the height of the second magnetic material core was 1.5 mm, while the height of the first magnetic material core was 2.1 mm. Here, the magnitude of the gaps 29*a* of the outer legs was adjusted using as the gap material 29, a tape which was made of polyimide, which was 50 μm thick and one surface of which was sticky. The gap material 29 was arranged across the middle part of the I-type core, in a direction perpendicular to a direction in which the conductors of the magnetic substance core assembly are taken out. The magnetic substance cores were joined to each other by coating parts not provided with the gap material, with a nonmagnetic adhesive. Incidentally, the gap between the second magnetic substance core 22*a* and the middle leg of the first magnetic substance core 22*b* was set at 160 μm (including the gap material). According to this example, since the I-type core which does not need to be more processed than the E-type core was used as the second magnetic substance core 22*a*, unlike in Example 4, a better productivity could be achieved in this configuration. The characteristics of inductances versus DC superposed currents are indicated in Table 5.

TABLE 5

| DC superposed current value (A) | Self-Inductance (μH) | Leakage Inductance (μH) |
|---|---|---|
| 0 | 0.310 | 0.114 |
| 4 | 0.309 | 0.113 |
| 8 | 0.308 | 0.113 |
| 12 | 0.303 | 0.112 |
| 16 | 0.297 | 0.110 |
| 20 | 0.287 | 0.108 |
| 24 | 0.268 | 0.107 |
| 28 | 0.233 | 0.107 |
| 32 | 0.166 | 0.107 |

As indicated in Table 5, the change rate of the self-inductance Ls is about −14% even under a DC superposed current of 24 A. This indicates that the large current of 24 A can be smoothed in spite of the small inductor having the geometries of 10 mm×14 mm. Thus, it has been proved that the inductor has a satisfactory performance for constituting a DC-DC converter which is required for driving a high-performance CPU.

As described above, according to the invention, it is possible to realize an inductor in which the value of a leakage inductance in a coupling inductor used in a DC-DC converter can be set at a magnitude required for a circuit, by providing a middle-leg non-formation part between two conductors and adjusting the size of the non-formation region. Since the value of the inductance can be set without altering the geometries of a magnetic substance core assembly, the present invention allows to provide the inductor of small size and low height.

What is claimed is:

1. An inductor comprising:

a first magnetic substance core having a middle leg, a first outer leg, a second outer leg, and a body portion interconnecting the middle leg, the first outer leg and the second outer leg, wherein the middle leg is formed with a region that is lower in height than the first outer leg, in a same direction as a longitudinal direction of the first outer leg;

a second magnetic substance core arranged opposite the first magnetic substance core;

a first conductor arranged in a first space that is defined by the middle leg, the first outer leg, a first part of the body portion and the second magnetic substance core;

a second conductor arranged in a second space that is defined by the middle leg, the second outer leg, a second part of the body portion and the second magnetic substance core; and a gap material arranged between the first magnetic substance core and the second magnetic substance core, wherein the gap material is arranged between only a part of opposite surfaces of the first and second magnetic substance cores such that a size of a gap formed between the first outer leg of the first magnetic substance core and opposite parts of the second magnetic substance core on sides of the inductor from which the first and second conductors extend is smaller than a size of a gap formed between the middle leg of the first magnetic substance core and the opposite parts of the second magnetic substance core on the sides of the inductor from which the first and second conductors extend.

2. An inductor as defined in claim 1, wherein the region of the middle leg which is lower in height than the first outer leg has a coupling coefficient set so as to be less than 0.9, the coupling coefficient indicating a degree of electromagnetic coupling that is determined by a self-inductance of said first conductor, a self-inductance of said second conductor and a mutual inductance between the first and second conductors.

3. An inductor as defined in claim 1, wherein said first conductor and said second conductor are rectilinearly arranged along the first space and the second space, respectively.

4. An inductor as defined in claim 1, wherein the region of the middle leg which is formed lower in height than the first outer leg is also formed lower in height than the second outer leg, in a same direction as a longitudinal direction of the second outer leg, and wherein the gap material is arranged between the opposite surfaces of the first and second magnetic substance cores such that a size of a gap formed between the second outer leg of the first magnetic substance core and the opposite parts of the second magnetic substance core on the sides of the inductor from which the first and second conductors extend is smaller than the size of the gap formed between the middle leg of the first magnetic substance core and the opposite parts of the second magnetic substance core on the sides of the inductor from which the first and second conductors extend.

5. An inductor as defined in claim 1, wherein the gap material includes a nonmagnetic substance.

6. An inductor as defined in claim 1, wherein the region of the middle leg which is lower in height than the first outer leg is formed so as to couple the first space and the second space.

7. An inductor as defined in claim 1, wherein the region of the middle leg which is lower in height than the first outer leg is formed at a position at which the middle leg is divided into a plurality of regions.

8. An inductor as defined in claim 1, wherein the region of the middle leg which is lower in height than the first outer leg is formed to have uniform height in the same direction over the whole middle leg.

9. An inductor as defined in claim 1, wherein the self-inductances of said first conductor and said second conductor and the mutual inductances between said first and second conductors are adjusted by, at least, a size of the region of the middle leg which is lower in height than the first outer leg.

10. An inductor as defined claim 1, further comprising insulating members arranged along the sides of the inductor from which the first and second conductors extend, and wherein the first and second conductors extend from the inductor over the insulating members and to lower surfaces of the insulating members to thereby form surface mounting terminals at the lower surfaces of the insulating members.

11. An inductor as defined in claim 10, wherein each of the insulating members includes conductor passing holes through which said first conductor and said second conductor pass.

12. An inductor as defined in claim 1, wherein each of said first conductor and said second conductor respectively arranged in the first space and the second space is covered with an insulating material.

13. An inductor as defined in claim 1, wherein each of the first and second magnetic substance cores is formed of a ferrite material.

14. An inductor as defined in claim 13, wherein each of the first and second magnetic substance cores has a saturation flux density of at least 550 mT.

15. An inductor as defined in claim 1, wherein each of the first and second magnetic substance cores is formed of a magnetic substance core into which metal powder is molded.

16. An inductor as defined in claim 1, wherein said first and second conductors and the first and second magnetic substance cores are unitarily molded.

17. An inductor as defined in claim 1, wherein at least one of the first magnetic substance core and the second magnetic substance core is formed of at least two different magnetic substances.

18. An inductor as defined in claim 1, wherein the first magnetic substance core and the second magnetic substance core are formed of magnetic substances different from each other.

19. An inductor as defined in claim 1, wherein a shape of the second magnetic substance core is the same as a shape of the first magnetic substance core, and the first outer leg, the middle leg and the second outer leg of the first magnetic substance core are respectively arranged in opposition to the corresponding outer legs and the middle leg of the second magnetic substance core.

20. An inductor as defined in claim 1, wherein the second magnetic substance core is an I-type core.

21. An inductor as defined in claim 1, wherein the first magnetic substance core is an E-type core.

22. An inductor as defined in claim 1, wherein said first conductor and said second conductor have regions in which self-inductance components of the respective conductors and mutual inductance components between the first and second conductors differ along longitudinal directions thereof.

23. An inductor as defined in claim 1, wherein said first conductor and said second conductor have a region in which a function as a common choke is predominant, and at least a region in which a function as a normal choke is predominant, along longitudinal directions thereof.

* * * * *